US006202516B1

(12) United States Patent
Kim

(10) Patent No.: US 6,202,516 B1
(45) Date of Patent: Mar. 20, 2001

(54) UNIVERSAL SELF-ADJUSTING WRENCH

(76) Inventor: Kwang-Moo Kim, 755-3, Kyomoon-Dong, Koori, Kyunggi-Do (KR)

( * ) Notice: Subject to any disclaimer, the term of this patent is extended or adjusted under 35 U.S.C. 154(b) by 0 days.

(21) Appl. No.: 09/310,228

(22) Filed: May 12, 1999

(30) Foreign Application Priority Data

May 21, 1998 (KR) ..... 98-8465

(51) Int. Cl.[7] ..... B56B 13/12
(52) U.S. Cl. ..... 81/179; 81/129
(58) Field of Search ..... 81/58.2, 129, 179, 81/186

(56) References Cited

U.S. PATENT DOCUMENTS

| | | | | |
|---|---|---|---|---|
| 2,647,425 | * | 8/1953 | Mortensen | 81/179 X |
| 2,697,372 | * | 12/1954 | Lane | 81/179 |
| 3,306,142 | * | 2/1967 | Buteau | 81/179 |
| 4,706,528 | * | 11/1987 | Inoue | 81/179 |
| 5,533,428 | * | 7/1996 | Pradelski | 81/179 |

* cited by examiner

*Primary Examiner*—David A. Scherbel
*Assistant Examiner*—Anthony Ojini

(57) ABSTRACT

A wrench includes a handle portion and a head portion coextensively connected with the handle portion. The head portion of the wrench has opposing flat surface faces and first and second jaw portions defining a substantially arcuate crescent interior of the wrench head. A slot is formed in the first jaw portion, the slot having a hole formed at a base end thereof through the head portion for access from an external peripheral surface of the head portion. A block member is slidably received within the slot, the block member including a base end and an exposed end, the exposed end protruding into the open crescent area, and a threaded hole formed in the base of the block member. A coiled spring is positioned between a base end of the block member and the base end of the slot, and a screw having a shank and a threaded tip at one end of the shank is inserted into the base of the block via the hole formed at the base of the first jaw portion, through the coiled spring, and is secured by engaging the threaded portions of the screw and the block. A securing bracket prevents displacement of the block member from the slot. The block member is adjustable to the extent that the spring compresses and otherwise functions as if it were integrally formed with the first jaw portion of the wrench head.

8 Claims, 3 Drawing Sheets

UNIVERSAL SELF-ADJUSTING WRENCH

BACKGROUND OF THE INVENTION

1. Field of the Invention

This invention relates to a spanner, otherwise known as a wrench. More specifically, the present invention concerns a universal and self-adjusting wrench having a spring biased member for selectively engaging with a nut or bolt. The present invention is low in cost and can be used with a variety of sized bolts as well as defective bolts.

2. Description of Related Art

In connection with wrenches in general, it is known that simple wrenches require manual adjustment to be used on different sized bolts, and in some instances require a selection and replacement of certain parts in order to use the same wrench on various sizes of bolts. For this reason, there is a preference among some users for a ratchet type wrench, whereby the adjustable parts of the ratchet are self contained and manually adjustable to the desired size of bolt. These manually adjustable ratchet type wrenches are cumbersome and can cause delay when attempting to adjust it to the proper size for bolt removal or application. Additionally, the ratchet type of wrenches have numerous parts which may be prone to breakage and difficulty of adjustment over a period of time. Accordingly, a need in the art exists for a wrench which may be used similar to a ratchet type of wrench, without the problems associated therewith. Therefore, the inventor has solved this problem in the art by providing a wrench which automatically adjusts to the size required to tighten or release a bolt, and is simple to use.

SUMMARY OF THE INVENTION

Therefore, it is the object of this invention to provide a wrench easily used on a wide variety of common sized bolts.

It is a further object of this invention to provide a wrench which is self adjusting without manual intervention.

It is still another object of this invention to provide a self-adjusting wrench that is easy to use on either normal or defective bolts.

These and other objects of the invention are achieved by providing a wrench including a handle portion and a head portion coextensively connected with the handle portion. The head portion of the wrench has opposing flat surface faces and first and second jaw portions defining a substantially arcuate crescent interior of the wrench head. A slot is formed in the first jaw portion, the slot having a hole formed at a base end thereof through the head portion for access from an external peripheral surface of the head portion. A block member is slidably received within the slot, the block member including a base end and an exposed end, the exposed end protruding into the open crescent area, and a threaded hole formed in the base of the block member. A coiled spring is positioned between a base end of the block member and the base end of the slot, and a screw having a shank and a threaded tip at one end of the shank is inserted into the base of the block via the hole formed at the base of the first jaw portion, through the coiled spring, and is secured by engaging the threaded portions of the screw and the block. A securing bracket prevents displacement of the block member from the slot. The block member is adjustable to the extent that the spring compresses and otherwise functions as if it were integrally formed with the first jaw portion of the wrench head.

BRIEF DESCRIPTION OF THE DRAWINGS

For a clearer understanding of the features and advantages of this invention, a preferred embodiment thereof will be described hereinafter with reference to the accompanying drawings, wherein.

DETAILED DESCRIPTION OF PREFERRED EMBODIMENTS

Figure 1:
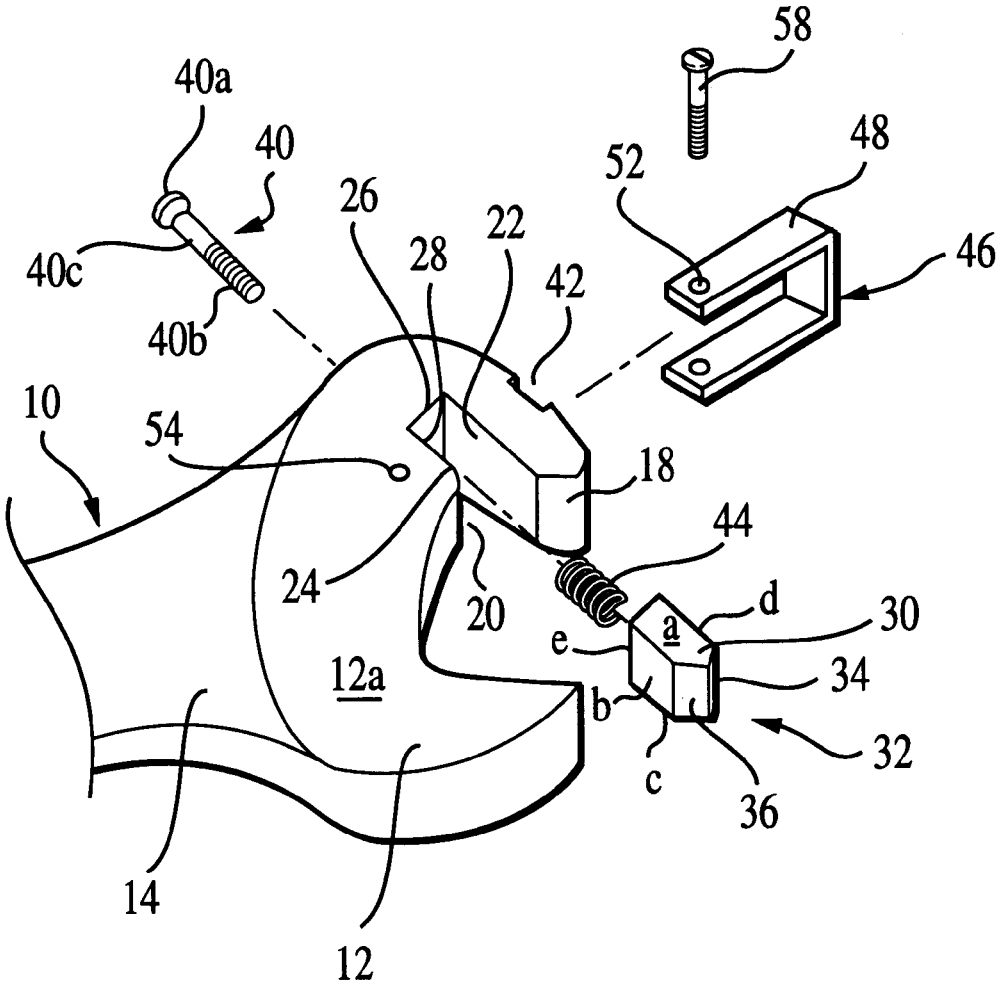
FIG. 1 is a perspective and exploded view of a self-adjusting wrench according to a preferred embodiment of the invention.

With specific reference to FIG. 1, there is shown a self-adjusting wrench 10 of the present invention for use with a wide variety of common sized bolts.

More specifically, the wrench 10 includes a head portion 12 and a handle portion 14. The head 12 and handle 14 are generally formed of a one-piece construction as is known in the art, and the connection thereof will therefore not be described in further detail.

The wrench head 12 is of a substantially crescent shape and as is common in the art, the wrench head 12 is flat on opposing surfaces 12*a* and 12*b* thereof. The wrench head 12 includes a first jaw portion 16 and a second jaw portion 18. The first jaw portion 16 is similar to that known in the art. However, the second jaw portion 18 includes features therein which characterize the substance of the invention.

Specifically, the second jaw portion 18 includes an incised groove or slot 20 formed therein. The slot 20 is formed to be of a rectangular internal shape and includes a first side wall 22 of a greater length than an opposing and parallel second side wall 24. The opposing first 22 and second 24 side walls are connected by a base wall 26. The base wall 26 is substantially oriented toward the exterior of the wrench head 12.

A screw hole 28 is formed in the base wall 26 of the slot 20 and parallel to the side walls 22, 24 of the slot 20. The screw hole 28 is smooth for reasons to be described further hereinafter.

An automatically adjusting break block 30 is slidable into the slot 20 of the wrench head 12. In particular, the break block 30 is primarily rectangular in shape having four side surfaces 30*a*, 30*b*, 30*c*, and 30*d* so as to correspond with the flat surfaces 22, 24, and 26 of the slot 20 and the flat faces 12*a*, 12*b* of the wrench head 12, respectively, and a base end 30*e* corresponding to the base wall 26 of the wrench head 12. The break block 30 additionally has an exposed end 32 which projects into an interior of the crescent of the wrench 10. The exposed end 32 includes a sliding surface 34 and a support surface 36. Essentially, the sliding surface 34 is at the longest and first side wall 22 of the head 12, and tapers into the support surface 36 at the shorter and second side wall 24 of the head 12.

The base end 30*e* of the break block 30 has a longitudinal hole 38 formed therein, and the hole 38 is preferably threaded. Upon assembly, a screw member 40 having a head end 40*a* and a threaded end 40*b* is inserted into the screw hole 28 and into the threaded hole 38 in the base end 30*e* of the break block 30. In order to allow for longitudinal movement of the break block 30 within the slot 20, a coiled spring 44 is inserted on a shank 40*c* of the screw 40 inside the slot 20 and against the base 30*e* of the break block 30.

In order to hold the break block 30 securely within the slot 20 of the wrench head 12, an outer surface of the second jaw 18 is notched at 42 to receive a U-shaped bracket 46, and more specifically, a closed end 48 of the U-shaped bracket 46. Distal ends 50 of the U-shaped bracket 46 each have a hole 52 formed therein to correspond to a hole 54 formed in the head 12 of the wrench 10. The hole 54 in the head 12 of the wrench 10 is formed from flat face 12*a* to flat face 12*b* of the head 12. In order to secure the break block 30, a pin 58 is inserted through the holes 52 on the distal ends 50 of the U-shaped bracket 46 as well as through the hole 54 formed in the head 12 of the wrench 10. The pin 58 may be secured by means of welding or other known securing methods in the art so as to provide a fairly smooth result on the flat face 12*a* or 12*b* of the wrench head 12.

It should be understood that the exposed end 32 of the break block 30 of the wrench 10 is therefore moveable into and out of the inner crescent surface portion upon operation of the wrench. More specifically, and referring to FIGS. 2A and 2B of the drawings, when the wrench head 12 surrounds a bolt head 60, the sliding surface 34 of the exposed end 32 of the break block 30 will "give", thereby compressing the coiled spring 44 between the base end 30*e* of the break block 30 and the base wall 26 of the slot 20 until the bolt head 60 is entirely within the crescent of the wrench head 12. Upon completely receiving the bolt head 60, the support surface 36 of the break block 30 will be in surface engagement with one of a plurality of flat sides (for example side 62) of the bolt head 60. Upon turning the wrench head 12 in a counter-clockwise direction as shown by arrows 66, all of the force from the inner surface of the wrench head 12 will be on opposite sides (62, 64) of the bolt head 60 as shown. Because the support surface 36 of the break block 30 is in surface contact with the flat surface 62 of the bolt head 60, the support surface 36 is an operative part of the wrench head 12.

Figure 2A:
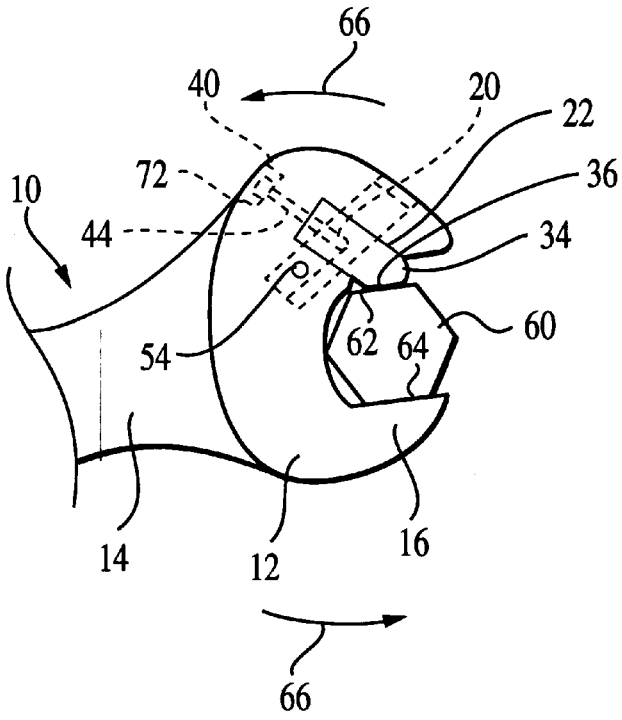
FIG. 2A is a plan view of the self-adjusting wrench according to FIG. 1 in a counterclockwise bolt loosening direction.
Figure 2B:
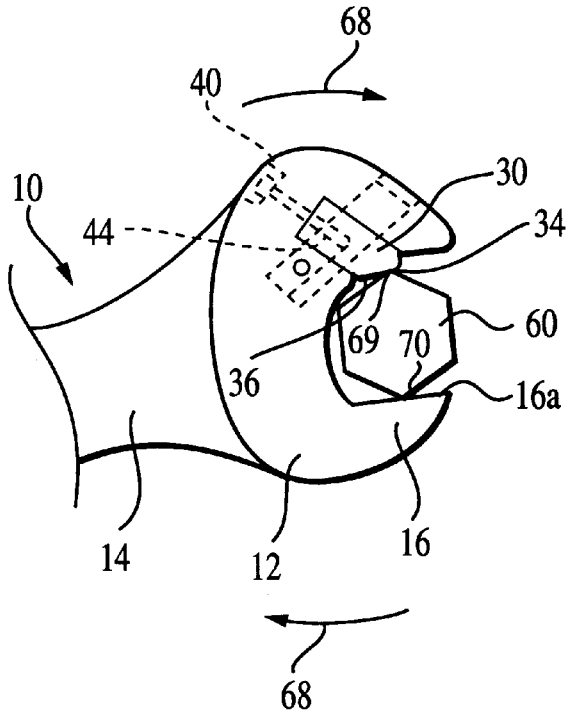
FIG. 2B is a plan view of the self-adjusting wrench according to FIG. 1 in a clockwise movement around a bolt being loosened.

When the wrench head 12 is turned in the clockwise direction as shown by arrows 68 in FIG. 2B, the sliding surface 34 of the break block 30 easily slides over the angled portions 68, 70, for example, of the bolt head 60 until the support surface 36 and inner surface 16*a* of the first jaw 16 again contact with flat surfaces 62, 64 of the bolt head 60 for another counter-clockwise turning of the wrench head 12 and thus the bolt head 60.

In other words, upon loosening of a bolt as shown in FIGS. 2A and 2B, when a force is applied against the support surface 36 of the break block 30, this force is directly translated to the first side wall 22 of the slot 20 regardless of how far compressed the coiled spring 44 is within the slot 20. The nut 60 is gripped securely between the support surface 36 and the inner surface 16*a* of the first jaw 16 on the wrench head 12.

The advantages are clear and can be easily seen. For example, compression of the coiled spring 44 accommodates various sizes of bolt heads 60 within a predetermined range, thus enabling use of the wrench on a variety of bolt head sizes. This eliminates the need to search for a wrench of the exact size of the bolt being tightened or loosened. All the while, a secure grip is maintained on the bolt head 60, regardless of its size.

Figure 3:
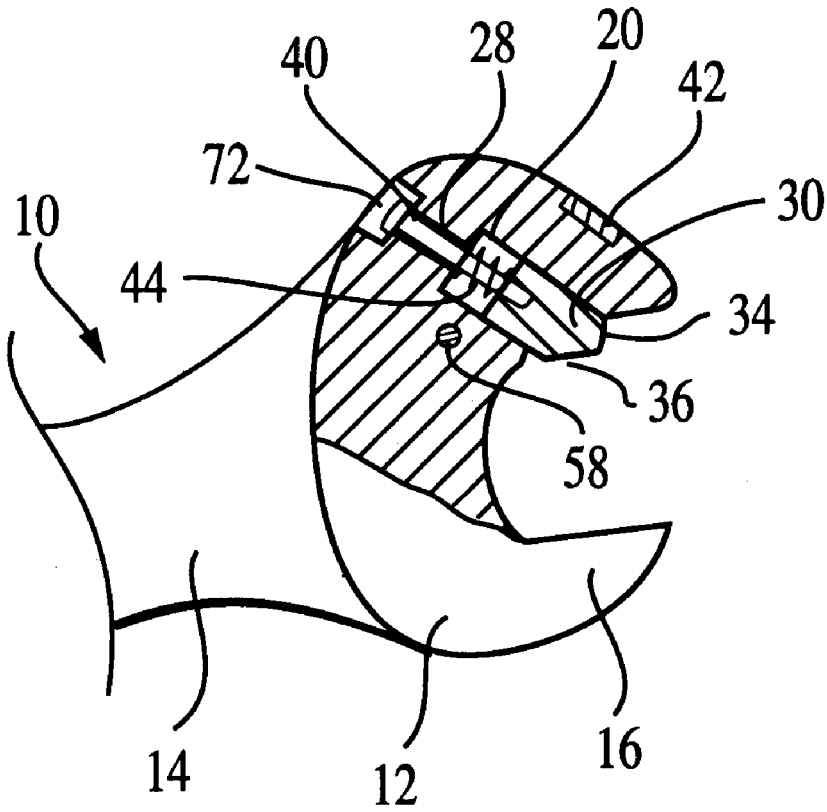
FIG. 3 is a plan and partial sectional view of the self-adjusting wrench of FIG. 1.

Turning now to FIG. 3, there is shown a plan and partly sectional view of the wrench head according to the present invention. Here, it is clear how the parts of the invention described are connected. In particular, FIG. 3 shows most clearly that a recess 74 may be provided in the outer periphery of the wrench head 12 to accommodate the head 40*a* of the screw 40.

It should also be understood that the wrench 10 is "reversible" as with any other wrench and may be used from the necessary side according to a tightening or loosening of a bolt, and the user's access to the subject bolt. Additionally, the wrench head 12, with the adjustable break block 30, is able to easily grip defective or bolt heads of a non-uniform size, particularly due to the spring bias of the break block 30.

Accordingly, the present invention is revolutionary in eliminating discomfort, increasing ease of use, and may be made for a lower cost than known rachet-type wrenches.

The ability to rotate the wrench 10 and thus the head 12 clockwise or against the support surface 36 without removing the wrench head 12 from the bolt 60 renders the operation somewhat similar to a ratchet type wrench without the cost, complicated assembly, and frequent breakage associated therewith.

Accordingly, the automatically adjustable wrench of the present invention, having ratchet type characteristics without the complications of a ratchet type wrench is easy to use on either normal or defective bolts, is durable, and has a low cost associated with production.

It should be understood that although an open style crescent wrench is shown and described, the essential aspects of the invention may be applicable to other tools as well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An open wrench comprising:

a handle portion;

a head portion coextensively connected with the handle portion and including opposing flat surface faces, first and second jaw portions defining a substantially arcuate crescent interior, a slot formed in said first jaw portion, said slot having a screw hole formed at a base end thereof through said head portion for access from an external peripheral surface of said head portion, a block member slidably received within said slot, said block member having a base end and an exposed end, the exposed end protruding into an open area defined by said first and second jaw portions, and a threaded hole formed in the base of the block member, a coiled spring positioned between a base end of said block member and the base end of said slot, and a screw having a shank, a threaded tip at one end of the shank and a head end at the opposite end of the shank;

a securing bracket for preventing displacement of said block member from said slot, wherein said block member is secured within said slot upon screwing the threaded tip of said screw into the base end of said block, the shank of said screw receiving said coiled spring, and upon securement of said securing bracket against the opposite flat faces of said wrench head, said block member being selectively adjustable within said slot upon compression of the exposed end of said block.

2. The wrench according to claim 1, wherein the exposed end of said block member includes a sliding surface and a support surface.

3. The wrench according to claim 1, wherein said slot includes a first side wall and a second side wall opposite to the first side wall, said first and second side walls being flat to correspond to flat sides of said block member, the first side wall being longer than the second side wall.

4. The wrench according to claim 3, wherein said head portion includes a recess therein parallel to said first side wall and on an outer peripheral surface of said head, and a pin hole formed through said wrench head between opposite faces thereof and adjacent to said second side wall.

5. The wrench according to claim 4, wherein said bracket is U-shaped, whereby a closed end of the U-shape seats within said notched recess, and distal ends of said U-shape each have a hole formed therethrough in alignment with the hole formed in said wrench head.

6. The wrench according to claim 5, further comprising a fixed pin inserted through the holes of said U-shaped bracket and the hole of said wrench head for securing said bracket to said wrench head.

7. The wrench according to claim 1, wherein said head includes a recess formed therein on an outer peripheral surface thereof for receiving the head end of said screw therein.

8. The wrench according to claim 1, wherein the sliding surface of said break block tapers into the support surface of said break block, such that the sliding surface protrudes beyond the support surface on the exposed end of said break block.

* * * * *